US008696607B2

(12) United States Patent
McDonnell et al.

(10) Patent No.: US 8,696,607 B2
(45) Date of Patent: Apr. 15, 2014

(54) PORTABLE PRESSURE POINT MASSAGE BED

(75) Inventors: Joseph A. McDonnell, Miramar, FL (US); Nicholas John Ruggiero, Parkland, FL (US); Joel A. Tunon, Sunrise, FL (US)

(73) Assignee: Great Innovations, LLC, Miramar, FL (US)

( * ) Notice: Subject to any disclaimer, the term of this patent is extended or adjusted under 35 U.S.C. 154(b) by 983 days.

(21) Appl. No.: 12/081,158

(22) Filed: Apr. 11, 2008

(65) Prior Publication Data

US 2009/0259151 A1 Oct. 15, 2009

(51) Int. Cl.
*A61H 7/00* (2006.01)

(52) U.S. Cl.
USPC ..... 601/134; 606/240; 5/633; 5/733; 5/944; 128/845

(58) Field of Classification Search
USPC ..... 128/99.1, 112.1, 845; 601/56, 134, 144, 601/146, 49, 23–24, 148; 606/240, 241, 606/201–202, 204; 5/633, 731, 733, 652, 5/944, 630, 635–636; 604/204
See application file for complete search history.

(56) References Cited

U.S. PATENT DOCUMENTS

| | | | | |
|---|---|---|---|---|
| 365,152 | A | | 6/1887 | Simson |
| 433,508 | A | | 8/1890 | Akers |
| 548,353 | A | | 10/1895 | Brintnall |
| 726,054 | A | | 4/1903 | Hartford |
| 1,833,426 | A | * | 11/1931 | Knudson ..... 606/240 |
| 3,835,844 | A | | 9/1974 | Lang |
| 3,974,532 | A | | 8/1976 | Ecchuya |
| 4,230,099 | A | * | 10/1980 | Richardson ..... 606/240 |
| 4,258,706 | A | | 3/1981 | Shank |
| 4,347,838 | A | | 9/1982 | McCauley |
| 4,383,342 | A | | 5/1983 | Forster |
| 4,421,110 | A | | 12/1983 | DeLisle et al. |
| 4,509,219 | A | | 4/1985 | Yagi |
| 4,736,735 | A | | 4/1988 | Yong |
| 4,901,387 | A | | 2/1990 | Luke |
| 5,702,333 | A | * | 12/1997 | Waldron et al. ..... 482/131 |
| 5,792,082 | A | | 8/1998 | Yamanaka et al. |
| 5,820,573 | A | * | 10/1998 | Ramos ..... 601/134 |
| 5,925,003 | A | | 7/1999 | Vincent et al. |
| 6,036,719 | A | | 3/2000 | Meilus |
| 6,041,457 | A | | 3/2000 | Summers |
| 6,202,237 | B1 | | 3/2001 | Chang |
| 6,704,961 | B2 | | 3/2004 | Kienlein |
| 7,311,681 | B1 | * | 12/2007 | Vaccarella et al. ..... 601/46 |
| 2004/0147959 | A1 | * | 7/2004 | Shin ..... 606/240 |
| 2006/0241538 | A1 | | 10/2006 | Chen |
| 2007/0173750 | A1 | * | 7/2007 | Hudock ..... 601/128 |
| 2007/0213646 | A1 | | 9/2007 | Han |

* cited by examiner

*Primary Examiner* — Patricia Bianco
*Assistant Examiner* — Kari Petrik
(74) *Attorney, Agent, or Firm* — Bass, Berry & Sims PLC

(57) ABSTRACT

A portable massage bed having a plurality of pressure point pads that protrude from a surface of the massage bed and contact one or more key pressure points of a user to relieve pain in muscles and tendons in pain afflicted areas.

17 Claims, 3 Drawing Sheets

PORTABLE PRESSURE POINT MASSAGE BED

FIELD OF THE INVENTION

The present invention relates to a portable massage bed. More particularly, the present invention relates to portable pressure point massage bed that induces stress relief via contact with specific pressure points along the spinal column to relieve chronic neck and/or back pain.

BACKGROUND OF THE INVENTION

Neck and back pain may stem from a range of different issues, such as from an automobile accident or a fall to simple day-to-day activities, such as sleeping position, one's position while working at a computer, excessive standing and/or excessive sitting. However, neck, back and leg pain may be reduced or often eliminated by triggering key pressure points along the head, neck and back.

Traditional techniques, such as massage and acupressure, are often used to relieve pain by releasing muscular tension that causes headaches, back pain, leg pain, and the like. For example, acupressure is a technique where the fingers are used to apply firm pressure to key pressure points on the surface of the skin to release muscular tension. Among the advantages of acupressure is that it is generally safe and produces no side effects such as those that may result from the use of muscle relaxers or other drugs.

Due to difficulties in applying appropriate massage or acupressure techniques to oneself, a number of devices have been developed to aid a user in triggering key pressure points, including, for example, pillows, mats, pneumatic massage beds, and the like. However, none of these known devices effectively alleviate chronic neck, back and/or leg pain.

SUMMARY OF THE INVENTION

In accordance with at least one embodiment of the present invention, a portable massage bed may include a plurality of pressure point pads that protrude from a surface of the massage bed to come into contact with one or more key pressure points of a user so that pain may be relieved and muscles and/or tendons in pain afflicted areas may be relaxed. Other advantages and objects of the present invention will become apparent to those skilled in the art from the subsequent detailed description, appended claims and drawings.

BRIEF DESCRIPTION OF THE DRAWINGS

The present invention will become more fully understood from the detailed description given below and the accompanying drawings, which are given for purposes of illustration only, and thus do not limit the invention. In the drawings which illustrate the best mode presently contemplated for carrying out the present invention.

DETAILED DESCRIPTION OF THE EXEMPLE EMBODIMENTS

Figure 1:
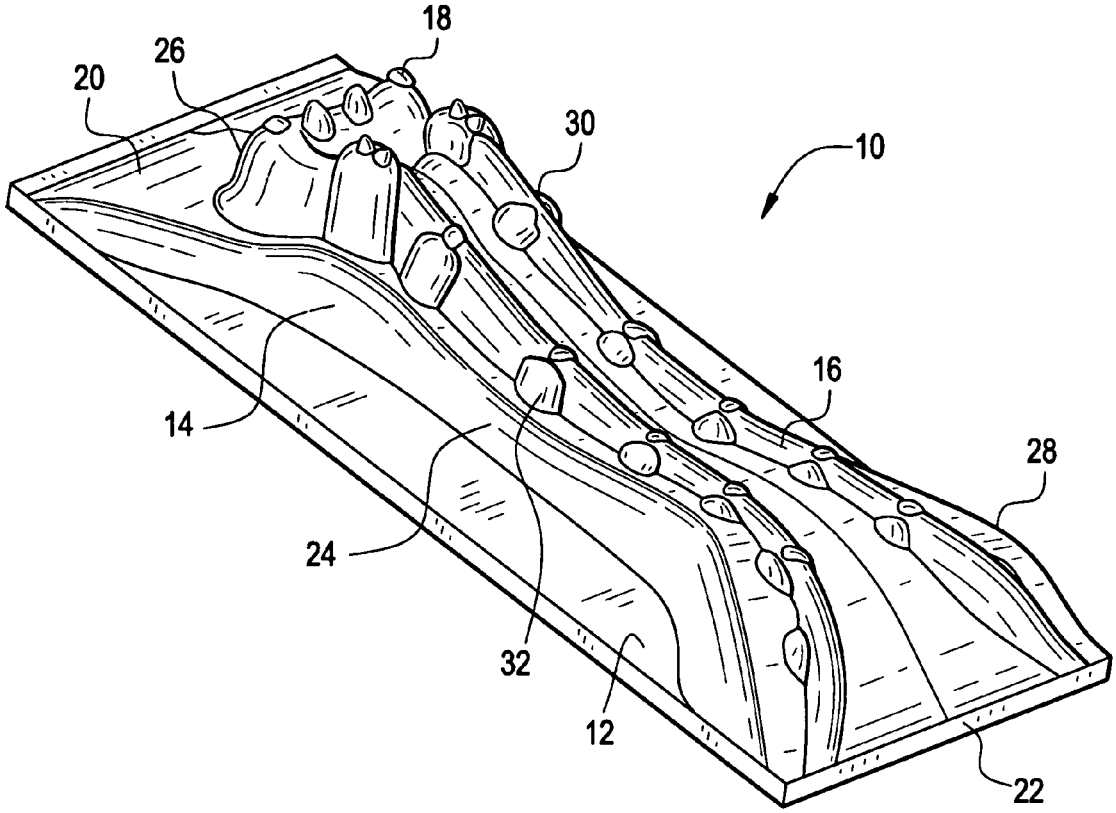
FIG. 1 is a perspective view of a pressure point massage bed in accordance with an embodiment of the present invention.

Referring now to the drawings in which like reference numerals designate like or corresponding parts throughout the several views, there is shown example embodiments of a pressure point massage bed, shown merely for the purpose of illustration. One skilled in the art will readily recognize from the following description, taken in conjunction with the accompanying drawings and claims, that the principles of the present invention may be applicable to other embodiments other than that shown for purposes of illustration in the drawings.

As shown in FIG. 1 a portable pressure point massage bed 10 may include a mat portion 12, a raised portion 14 formed on the mat portion 12 and a pair of elongated portions 16 that are arranged superior to the raised portion 14. The raised portion 14 is arranged intermediately between the mat portion 12 and the pair of elongated portions 16. A plurality of pressure point pads 18 are arranged on a surface of the pair of elongated portions 16.

Figure 2:
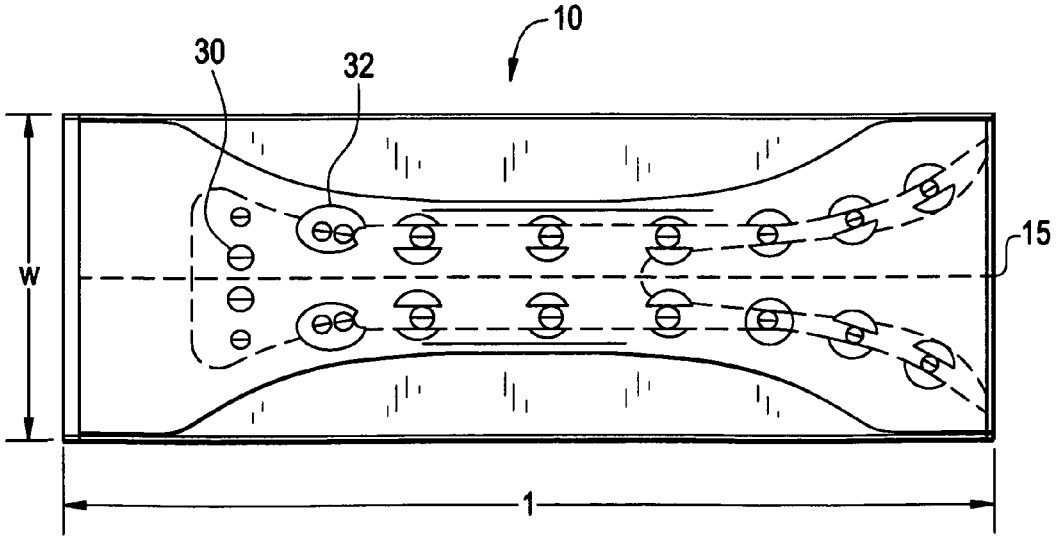
FIG. 2 is a top view of a pressure point massage bed in accordance with an embodiment of the present invention.

As shown in FIG. 2, the mat portion may be formed to have an essentially rectangular shape with a width W that is less than that of a length 1. In an example embodiment, the mat portion 12 may have, but is not limited to, a width W of about 10" and a length 1 of about 28".

Referring back to FIG. 1, the raised portion 14 may have an undulating surface that essentially conforms to the contours of the human back. The raised portion 14 may have a head end 20 formed at one end of the mat 12 and a lumbar end 22 formed at an opposite end of the mat 12. As shown in FIGS. 1 and 2, the head end 20 and the lumbar end 22 of the raised portion 14 may be wider in the width direction W than a middle portion 24. Additionally, as shown in FIG. 3, the middle portion 24 of the raised portion 14 may be lower in the height direction h than the head end 20 and the lumbar end 22.

Figure 5:
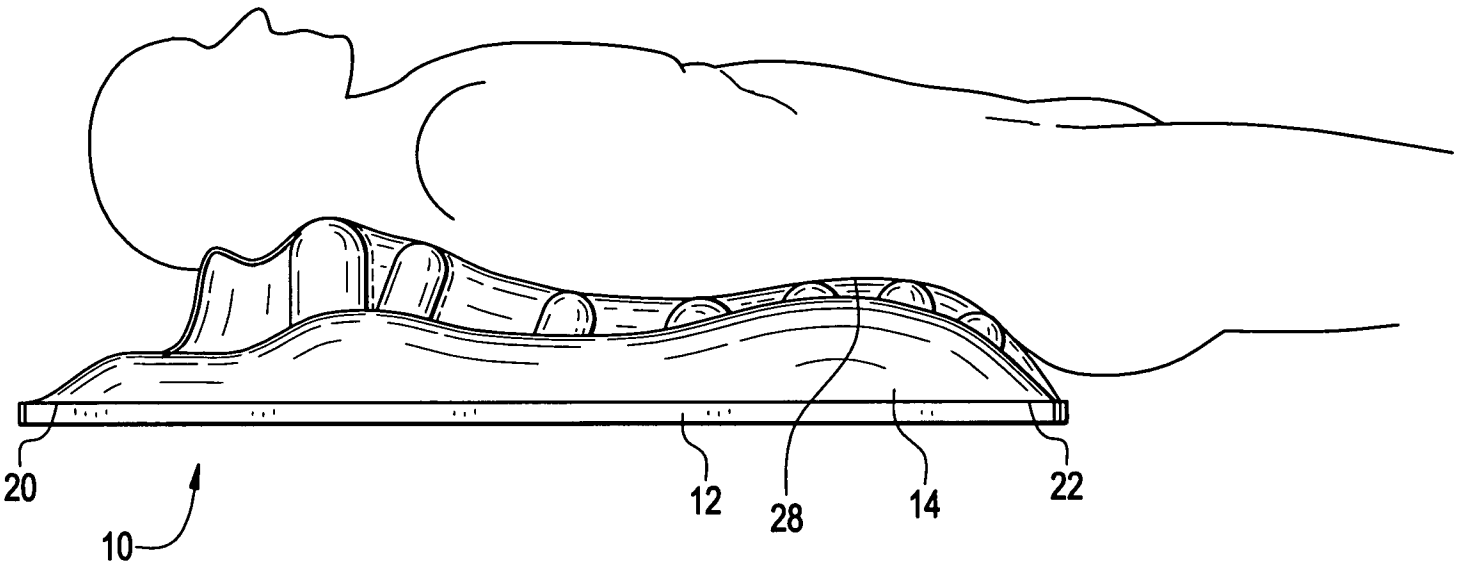
FIG. 5 is a side view of a user and a pressure point massage bed in accordance with an embodiment of the present invention.

The pair of elongated portions 16 are arranged on an upper surface of the raised portion 14 such that the elongated portions 16 protrude above the surface of the raised portion 14. The pair of elongated portions 16 may be arranged symmetrically on the raised portion 14 with respect to a longitudinal center line 15 of the mat 12 such that the elongated portions 16 are essentially mirror images of one another (see FIG. 2). In an example embodiment, a distance between the pair of elongated portions 16 may vary over the length of the raised portion 14. For example, a distance between the pair of elongated portions 16 may increase at the lumbar end 22 of the raised portion 14 to coincide with key pressure points in the lower back of a user. As shown in FIG. 5, the pair of elongated portions 16 at the lumbar end 22 form lumbar supporting portions 28 to support the lower back of a user of the portable pressure point massage bed 10. In an example embodiment, the pair of elongated portions 16 may join together at the head end 20 of the raised portion 14, as shown in FIG. 1, and thereby form a neck supporting portion 26 of a user of the portable pressure point massage bed 10.

Figure 3:
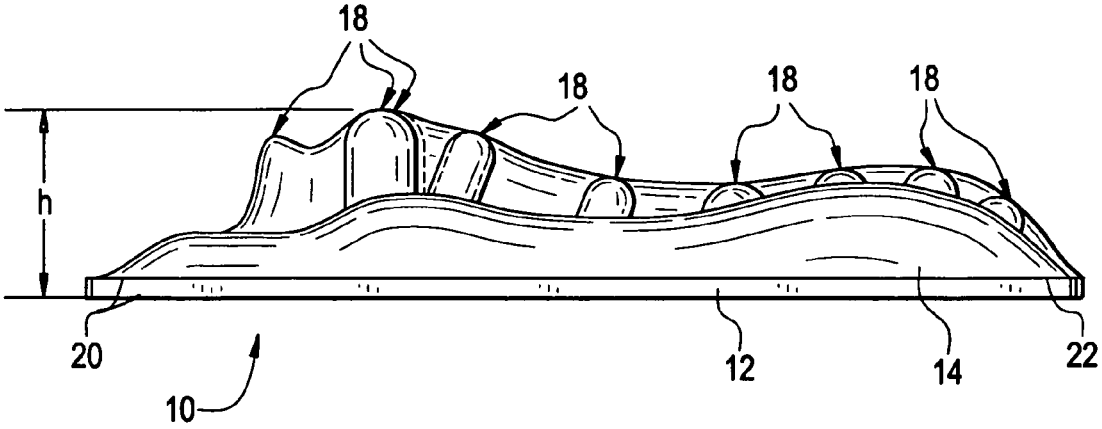
FIG. 3 is a side view of a pressure point massage bed in accordance with an embodiment of the present invention.

As shown in FIG. 3, a height of the plurality of pressure point pads 18 at a head end 20 in a height direction h may be higher than a plurality of pressure point pads 18 at the lumbar end 22 of the portable pressure point massage bed 10. However, in an example embodiment, as shown in FIG. 3, a portion of the lumbar end 22 of the raised portion 14 may be higher in a height direction h than the head end 20 of the raised portion 14 of the portable pressure point massage bed 10. This height relationship results from the elongated portions 16 having a greater height at the head end 20 than at the lumber end 22. As shown in FIG. 3, the elongated portions 22 gradually decrease from the head end 20 to the lumbar end 22.

The plurality of pressure point pads 18 are arranged on a surface of the pair of elongated portions 16 such that the plurality of pressure pads 18 protrude above the surface of the pair of elongated portions 16. The plurality of pressure pads 18 may be arranged symmetrically on the pair of elongated portions 16 with respect to a longitudinal center line 15 of the mat 12 such that the plurality of pressure pads 18 are essentially mirror images of one another. In an example embodiment, the plurality of pressure pads 18 may be arranged to contact key pressure points along the neck and back of a user. The plurality of pressure pads 18 may vary in dimension from one another. For example, as shown in FIG. 3, the plurality of pressure pads 18 at the head end 20 may be higher in a height direction h than the plurality of pressure pads 18 at the lumbar end 22 or the middle portion 24. As may be seen in FIG. 1, a radius of the plurality of pressure pads 18 may also vary from one another. For example, the radius of the plurality of pressure point pads 18 may increase as the height increases. Similarly, the radius of the plurality of pressure point pads 18 may increase in accordance with an amount of weight or pressure that may be applied to the plurality of pressure point pads 18.

Figure 4:
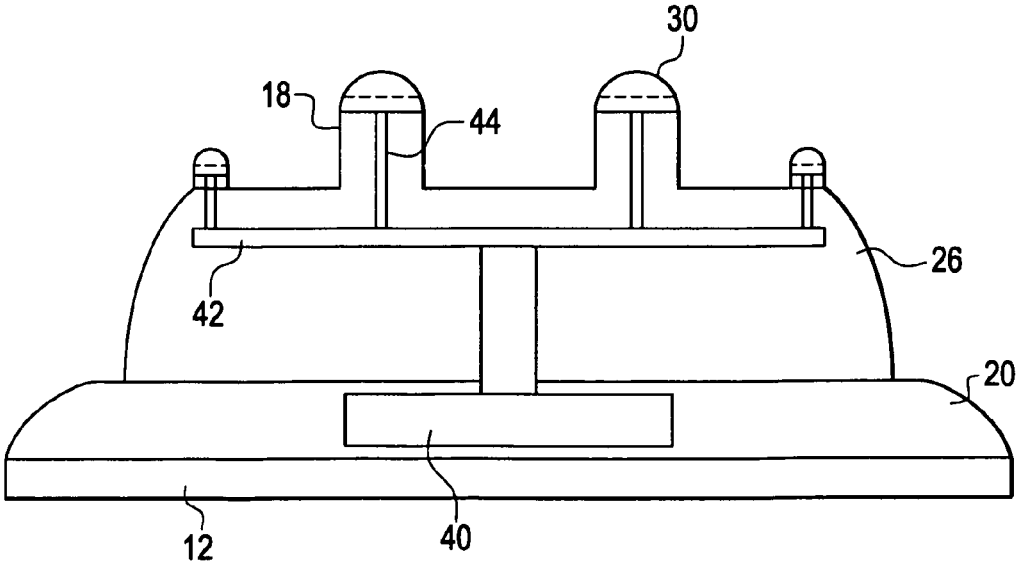
FIG. 4 is an end view of a pressure point massage bed having a vibrating device in accordance with an embodiment of the present invention.

As shown in FIGS. 1 and 4, in an example embodiment, the plurality of pressure point pads 18 may have rounded ends 30 that contact the user. The rounded ends 30 concentrate a point of contact such that the points of contact between the plurality of pressure point pads 18 and key pressure points on the user are focused to trigger a release of muscular and/or tendon tension and reduce pain.

In an example embodiment, the rounded ends 30 may comprise a material having a hardness greater than a remainder of the plurality of pressure point pads 18. Alternatively, the entire plurality of pressure point pads may be comprised of a material having a hardness greater than the remainder of the pressure point massage bed 10. For example, the plurality of pressure point pads and/or the plurality of rounded ends may include one or more of plastic, nylon, metal and wood.

As shown in FIG. 1, the plurality of pressure point pads 18 may be supported by pad supporting portions 32. As shown in FIGS. 1 and 2, the pad supporting portions 32 are arranged on the pair of elongated portions 16 at locations corresponding to the plurality of pressure point pads 18. Due to a potential for deformation of the plurality of pressure point pads 18 when in contact with a user, the pad supporting portions 32 may be arranged to minimize deflection of the pressure point pads 18. By minimizing deflection, pressure applied to key pressure points may be maximized. In an example embodiment, the pad supporting portions 32 are arranged on side surfaces of the pair of elongated portions 16 and contact a surface of the raised portion 14.

In an example embodiment, as shown in FIG. 4, the portable pressure point massage bed 10 may include a vibrating mechanism. The vibrating mechanism may include, but is not limited to, a motor 40 and a vibrator arm 42 connected to the motor 40 to conduct vibration to one or more rods 44. The motor 40, vibrator arm 42 and rods 44 may be housed within the portable pressure point massage bed 10. For example, the motor 40 may be, but is not limited to being, arranged in the head end 20 of the raised portion 14 at a location where the raised portion 14 is sufficiently thick to comfortably house the motor 40. The vibrator arm 42 may be, but is not limited to being, housed within the neck supporting portion 26. The rods 44 may be arranged within one or more of the plurality of pressure point pads 18 to conduct vibration to the plurality of pressure point pads 18 and ultimately to key pressure points of a user. By applying a vibration, release of a muscle and/or tendon causing pain may be readily triggered.

As shown in FIG. 4, in an example embodiment, the rods 44 may contact the rounded ends 30 and the rounded ends 30 may be comprised of a hard material, as discussed above, to increase the transference of vibration relative to a soft or pliable material, which may dampen the transference of vibration from the rods 44 to the plurality of pressure point pads 18.

As shown in FIG. 5, a user may position the portable pressure point massage bed 10 on a floor, table or other surface. The user would then lie on the pressure point massage bed 10 such that his or her head is positioned at the head end 20 and the plurality of pressure point pads 18 at the neck supporting portion 26 are in contact with key pressure points in the users head and/or neck. Similarly, the user would position his or her spine and lumbar such that the plurality of pressure point pads along the pair of elongated portions 16, including the lumbar supporting portions 28, are in contact with correlating key pressure points along either side of the spine and lumbar of the user.

By lying on the portable pressure point massage bed 10, the user's weight provides sufficient pressure at the points of contact between the user's body and the plurality of pressure point pads 18 to trigger key pressure points and relieve pain in the muscles and/or tendons.

The above detailed description describes example embodiments of the present invention. Persons skilled in the art will recognize that alternative embodiments are possible without departing from the scope and spirit of the present invention. The above detailed description describes different embodiments of the present invention. For example, the example embodiments of the portable pressure point massage bed discussed may be made of a variety of materials without departing from the scope and intent of this invention.

We claim:

1. A pressure point massage bed, comprising:

a mat portion;

an intermediate raised portion that extends upwardly from a surface of the mat portion and extends the length of the mat portion;

a pair of superior elongated portions on the intermediate raised portion; and a plurality of pressure point pads on the superior elongated portion, wherein the intermediate raised portion has a head end and a lumbar end having substantially the same dimension as the mat portion in a width direction and a middle portion that is narrower in the width direction than the head end and the lumbar end, wherein the pair of superior elongated portions protrude from a surface of the intermediate raised portion, and wherein a portion of the lumbar end of the intermediate raised portion has a height greater than a height of a portion of the head end of the intermediate raised portion.

2. The pressure point massage bed of claim 1, wherein the pressure point massage bed has a width and a length, the length being greater than the width.

3. The pressure point massage bed of claim 1, wherein the pair of superior elongated portions are continuous from the lumbar end to the head end of the intermediate raised portion.

4. The pressure point massage bed of claim 1, wherein the pair of superior elongated portions are symmetric and join together to form a neck supporting portion.

5. The pressure point massage bed of claim 1, wherein a distance between the pair of superior elongated portions varies.

6. The pressure point massage bed of claim 1, wherein a distance between the pair of superior elongated portions is greater at the lumbar end of the intermediate raised portion than at the head end of the intermediate raised portion.

7. The pressure point massage bed of claim 1, wherein the pair of superior elongated portions include a pair of lumbar supporting portions at the lumbar end of the intermediate raised portion.

8. The pressure point massage bed of claim 1, wherein the plurality of pressure point pads are spaced apart symmetrically on the superior elongated portion.

9. The pressure point massage bed of claim 1, wherein the plurality of pressure point pads include rounded end.

10. The pressure point massage bed of claim 9, wherein the plurality of rounded ends are comprised of at least one of plastic, nylon, wood and metal.

11. The pressure point massage bed of claim 1, further comprising:

pressure point pad supporting portions on either side of the pair of elongated superior portions where the pressure point pads are located.

12. The pressure point massage bed of claim 1, wherein a pressure point pad at the head end of the intermediate raised portion has a height greater than a pressure point pad at the lumbar end of the intermediate raised portion.

13. The pressure point massage bed of claim 1, wherein the middle portion of the intermediate raised portion is lower in a height direction than the head end and the lumbar end.

14. The pressure point massage bed of claim 1, wherein the plurality of pressure pads at the head end are higher in a height direction than the plurality of pressure pads at the lumbar end or the middle portion of the intermediate raised portion.

15. The pressure point massage bed of claim 1, wherein the plurality of pressure point pads are comprised of at least one of plastic, nylon, wood and metal.

16. The pressure point massage bed of claim 1, further comprising:

a vibrator motor in the pressure point massage bed;

a vibrator arm connected to the vibrating motor; and a rod in contact with a pressure point pad, the rod connected to the vibrator arm.

17. The pressure point massage bed of claim 1, wherein the mat portion has a substantially rectangular shape.

* * * * *